US005092804A

United States Patent [19]

Desmarais et al.

[11] Patent Number: 5,092,804

[45] Date of Patent: Mar. 3, 1992

[54] METHOD TO PRESS AND SHEAR HEAVY WALL METAL HALIDE LAMPS

[75] Inventors: Betina Desmarais, Exeter; Michael R. Kling, Stratham, both of N.H.

[73] Assignee: GTE Products Corporation, Danvers, Mass.

[21] Appl. No.: 560,912

[22] Filed: Jul. 31, 1990

[51] Int. Cl.[5] ..... H01J 9/26; H01J 9/32; H01J 9/40

[52] U.S. Cl. ..... 445/22; 65/59.25; 65/105; 445/26

[58] Field of Search ..... 445/22, 26, 43; 65/59.25, 59.27, 59.6, 105, 138, 154, 155

[56] References Cited

U.S. PATENT DOCUMENTS 1,945,769 2/1934 Brumley ..... 445/43
2,391,572 12/1945 Herzog ..... 445/26
2,391,573 12/1945 Herzog ..... 445/22

FOREIGN PATENT DOCUMENTS 591648 5/1945 United Kingdom ..... 65/105

*Primary Examiner*—Richard K. Seidel
*Assistant Examiner*—Jeffrey T. Knapp

[57] ABSTRACT

A method to press mold heavy wall metal halide lamps (with reduced glass mass in end seals) is disclosed. Wall temperature in a metal halide lamp may be normalized by varying the wall thickness in relation to the heat falling on the interior surface, and the heat lost through the exterior surface. Increasing the wall thickness, acts to spread the heat, and decrease the wall temperature. Thinning the wall, acts to concentrate the heat, and increase the wall temperature. By press molding the lamp glass and simultaneously reducing the glass mass in the end seals, the desired wall thickness may be obtained without excessive heat loss in the end seals to result in an isothermal internal profile.

5 Claims, 2 Drawing Sheets

METHOD TO PRESS AND SHEAR HEAVY WALL METAL HALIDE LAMPS

1. TECHNICAL FIELD

The invention relates to electric lamps and particularly to arc discharge electric lamps. More particularly the invention is concerned with a reduced mass seal for an arc discharge lamp, and a method for making the lamp seal.

2. BACKGROUND ART

A compact, low wattage metal halide lamp of acceptable life should have a wall thickness sufficient to withstand the heat and pressure of the enclosed lamp fill during lamp operation. Wall thicknesses for compact metal halide lamps are usually in excess of about 1.25 millimeters (0.050 inch). There are two ways to make a lamp capsule with this wall thickness. One method is to start with, relatively thin walled tubing and gather the tube material in the cavity region to increase the wall thickness. Gathering the tube material results in end seals adjacent the cavity with low thermal masses, but unfortunately frequently results in irregular surfaces. An alternative is to mold or press thick walled tubing. However, thick walled tubing results in massive end seals.

Both methods introduce difficulties. The problem with gathering material is in obtaining a uniform cavity with a consistent wall thickness. The irregularities in wall thickness make thermal conduction and light distribution inconsistent. The problem with thick wall tubing is reduced lamp performance due to energy loss, and altered thermal patterns. The heavy end seals act as heat sinks which lower the cold point of the lamp envelope. An ideal discharge cavity should possess a uniform wall temperature distribution with no cold spot. The optimum temperature should be extremely high, but below the critical temperature at which chemical reactions with the envelope material, commonly quartz, become a problem. Unfortunately, heavy end seals cause thermal nonuniformity. It is probable that the principle heat loss mechanisms in the seals are thermal radiation and convection. The heavy seals rob performance in several ways. The high heat loss to the seal ends results in a direct power loss, and cold spots in the seal ends of the cavity. The seal ends also act as heat sinks during warm-up which increases the warm-up time. An oxidation problem may also occur during lamp operation. The large cross-sectional area in the end seal causes the molybdenum foil to reach excessively high temperatures. When the exposed molybdenum end runs too hot, rapid oxidation occurs, resulting in seal failure. There is then a need for an arc discharge lamp with regular capsule walls and a low mass seal.

Examples of the prior art are shown in U.S. Pat. Nos. 3,685,880; 3,689,799; 3,989,970; and 4,612,475. Sobieski U.S. Pat. No. 3,685,880 shows a method of making an arc discharge lamp capsule. The drawing shows a prolate capsule with thinner walls adjacent the electrodes. Senft U.S. Pat. No. 3,689,799 concerns a method of dosing an arc discharge capsule, but shows an elongated capsule with thinner walls adjacent the electrode roots. Downing U.S. Pat. No. 3,989,970 shows a double ended arc discharge capsule with slightly thinner walls adjacent the electrodes, but otherwise concerns radiator fins coupled to the press seals. Downing U.S. Pat. No. 4,612,475 shows a double ended arc discharge capsule with slightly thinner walls adjacent the electrodes, but otherwise concerns the lamp fill composition.

DISCLOSURE OF THE INVENTION

A reduced mass arc discharge lamp capsule may be formed from a light transmissive enclosure having a first seal end, an intermediate capsule portion defining an enclosed volume, and an opposite second seal end. The lamp is formed to include a first electrode having a contact end, a seal portion captured in the first seal end of the capsule, and an exposed end positioned and exposed in the enclosed volume. The cross sectional area of the enclosure around the first electrode seal portion is preferably less than the cross sectional area of the enclosure around the enclosed volume. The lamp also includes a second electrode having a contact end, a seal portion captured in the second seal end of the capsule, and an exposed end positioned and exposed in the enclosed volume. A lamp fill is positioned in the enclosed volume.

BEST MODE FOR CARRYING OUT THE INVENTION

A method of press molding arc tubes is to shear envelope material, for example quartz, from the seal areas during pressing or molding. Shearing may be accomplished with a two piece press. The main pressing action forms a "butterfly" press seal with excess envelope material, commonly quartz or glass, flowing out the ends of the press heads. A pair of side plates then advance to shear off the excess quartz while the excess envelope material is still hot. The seal area where the excess material was sheared off may then be fire polished to heal any mechanical or esthetic defects if necessary. A similar shearing technique may be used to form the top seal area where the capsule is left open.

In the preferred embodiment, quartz tubing with an outside diameter of 5.0 millimeters and a wall thickness of 2.0 millimeters is press molded to form a tubular cavity. By modifying the press or press mold to include shearing side plates, an arc tube with reduced mass seal ends may be formed.

Figure 1:
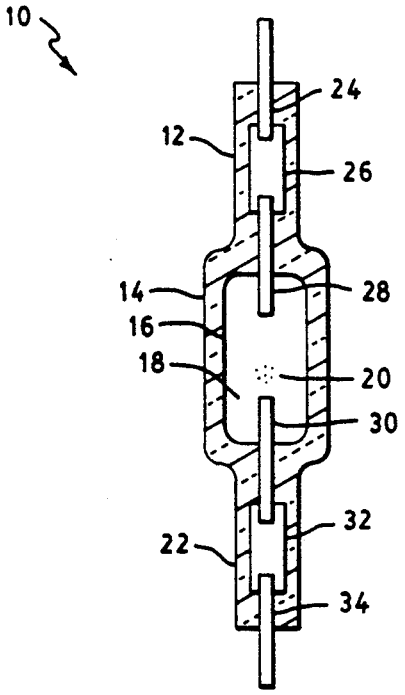
FIG. 1 shows a double ended tubular lamp capsule with reduced mass seal ends.

Several lamp types may be formed with the reduced mass seal structure. FIG. 1 shows a cross section of a doubled ended tubular lamp capsule with reduced mass seal ends. A doubled ended tubular arc discharge lamp 10 commonly has a mass of a light transmissive envelope material, such as quartz or glass formed by mechanical methods at elevated temperatures. The common double ended lamp capsule has a first press seal 12, leading to capsule wall 14 with an interior surface 16 defining an enclosed volume 18. In the example, the capsule wall 14 is cylindrical to define a tubular lamp capsule. Captured in the enclosed volume 18 is a lamp fill 20, typically comprising an inert gas, mercury and various dopants. Opposite the first press seal 12 is a second press seal 22. Captured in the first press seal is a first electrode. A common electrode structure is a first exterior lead 24 coupled to a first foil seal 26 which is in turn coupled to a first interior electrode 28. The first interior electrode 28 has one end captured in the first press seal 12, and an opposite end projecting into the enclosed volume 18.

A second interior electrode 30 similarly projects into the enclosed volume 18. The second interior electrode is commonly connected to a second seal foil 32 which in turn is coupled to a second lead 34 extending to the exterior. By applying electricity between the first lead 24 and the second lead 34 an arc may be struck between the first interior electrode 28 and the second interior electrode 30 thereby producing light.

The relevant aspect of the present design is the cross section of envelope material in one or both of the first seal area and the second seal areas has less envelope material than does a similar cross section of the envelope through the enclosed volume. The cross sectional mass is then less in the seal area. Simultaneously the envelope wall 14 has either substantially a constant thickness, or a evenly varying thickness in the axial direction extending away from the press seal region. The optical and thermal smoothness of the surface is then preserved. The reduced seal then conducts less heat, and remains relatively hotter; but more nearly equals the remaining enclosed volume walls in temperature, and energy conduction. The thermal uniformity then enhances overall lamp operation. Meanwhile, the formation process leaves the optical character of the capsule wall in a substantially regular condition, thereby not distorting the light projection patterns with surface irregularities.

Figure 2:
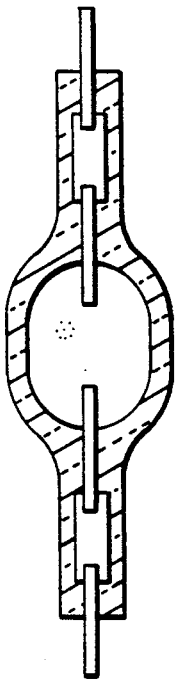
FIG. 2 shows a double ended bulbous lamp capsule with reduced mass seal ends.
Figure 3:
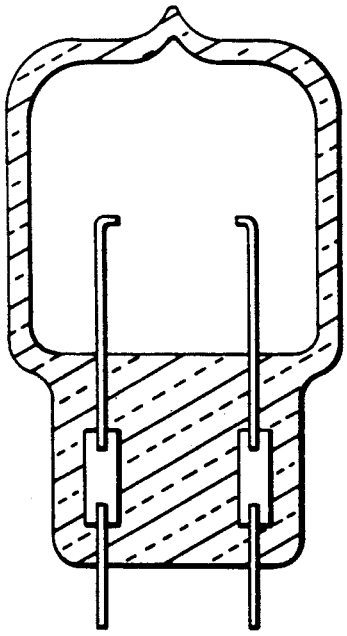
FIG. 3 shows a single ended tubular lamp capsule with a reduced mass seal end.
Figure 4:
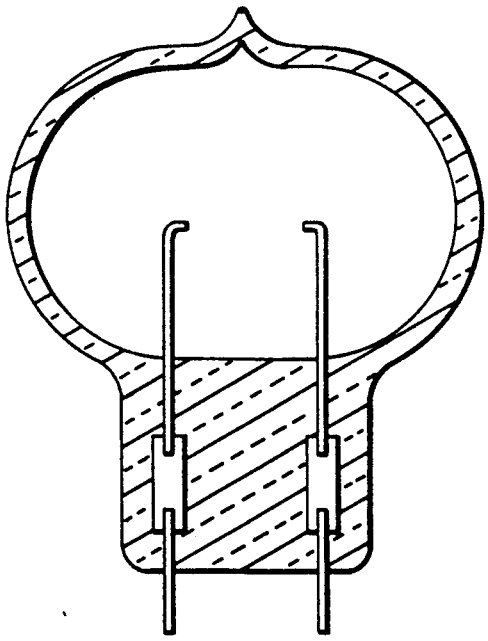
FIG. 4 shows a single ended bulbous lamp capsule with a reduced mass seal end.

Other lamp types may be made with the present pressing and shearing method. FIG. 2 shows a similar cross section for a double ended blown, or bulbous capsule arc discharge lamp. FIG. 3 shows a cross section of a single ended tubular lamp capsule with reduced mass seal ends. FIG. 4 shows a cross section of a single ended blown, or bulbous lamp capsule with reduced mass seal ends. The same pressing and shearing method may be extended to filamentary lamps as well.

The preferred method for forming a reduced mass seal lamp is to press seal the lamp, and while the press material is still pliable, to cut off excess material with cutters stationed adjacent the exterior sides of the press seal heads.

Figure 5:
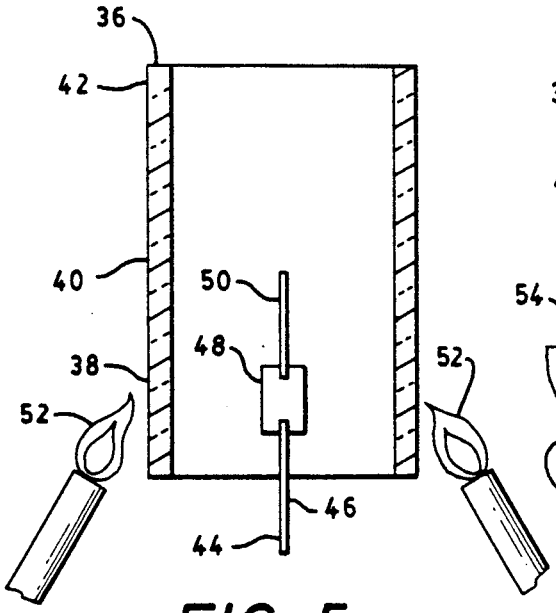
FIG. 5 shows a lamp preform being heated.

FIG. 5 shows an arc discharge lamp capsule preform 36. The preform 36 has the general form of a tube formed from a light transmissive material moldable at an elevated temperature. Glass and quartz are familiar materials for use as a capsule preform 36. The preform 36 has a first seal end 38, an intermediate capsule portion 40, and an opposite second seal end 42. The capsule preform 36 is positioned around a first electrode 44. The first electrode 44 has a first lead end 46, a seal portion 48 and an exposed inner electrode end 50. The capsule preform 36 is positioned around the electrode 44 so the first seal end 38 is adjacent the seal portion 48 of the electrode 44 and the intermediate capsule portion 40 surrounds the exposed inner electrode end 50. Heat is applied to the first seal end 38 by, for example, directing gas flames 52 about the first seal end 38. The flames 52 heat the preform 36, or at least the first seal end 38, to a softened state, pliable under the force of press seal heads.

Figure 6:
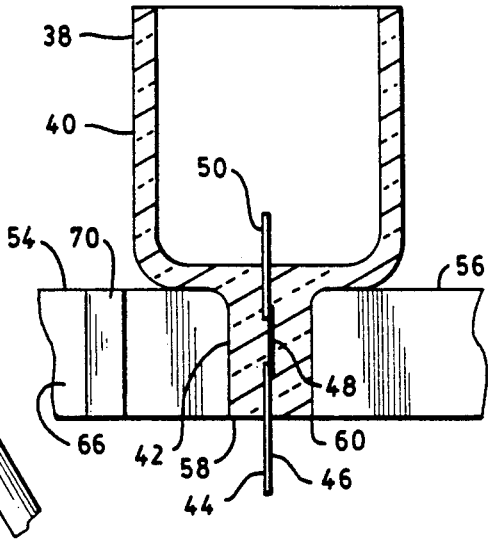
FIG. 6 shows a side view of a heated lamp preform being press sealed to an electrode end, allowing excess material to ooze from the press.

FIG. 6 shows the softened first seal end 38 being pressed around the first electrode 44 by press heads 54, 56. The press seal heads 54, 56 commonly consist of metal blocks with press faces 58, 60 that may be flat or sculpted to shape the press seal face of the lamp capsule. Mechanical pressure exerted by the press faces 58, 60 seals the envelope material to the seal portion 48, and molds the softened envelope material around the first lead end 46 and inner electrode end 50 to support the first lead end 46, and inner electrode end 50 in the molded material. Excess preform 36 material oozes from between the press faces 58, 60 and, extends beyond the press faces 58, 60 as overhanging masses 62, 64. Adjacent the sides of the first press head 54, are cutting elements, or knives 66, 68 in a withdrawn state ready to strike off the overhanging masses 62, 64. In the alternative, knives may be mounted on either side of either, or both press heads.

Figure 7:
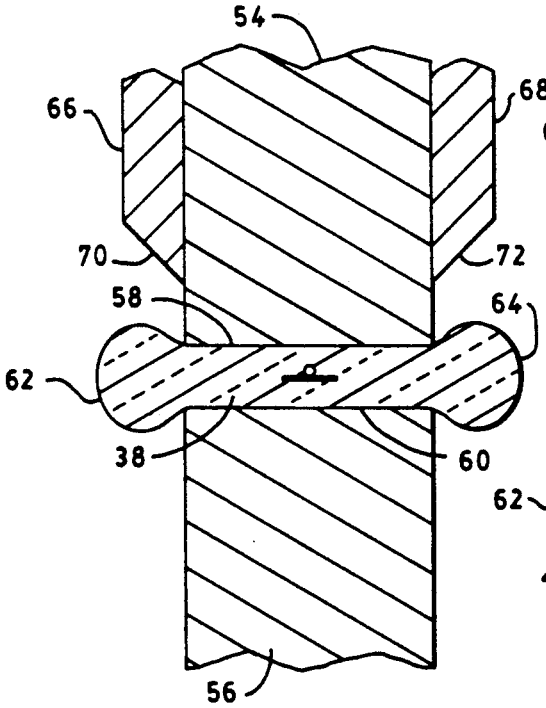
FIG. 7 shows a horizontal cross section of the press seal, press heads and knives partially broken prior to cutting away excess seal material.

FIG. 7 shows a horizontal cross section of the first seal end 38, press heads 54, 56 and knives 66, 68 partially broken away. FIG. 7 also shows the first seal end 38 being closed by the press heads 54, 56, allowing excess material to extend beyond the press faces 58, 60 as over hanging masses 62, 64. The knives 66, 68 have not been advanced and remain withdrawn on the sides of a press head 54.

Figure 8:
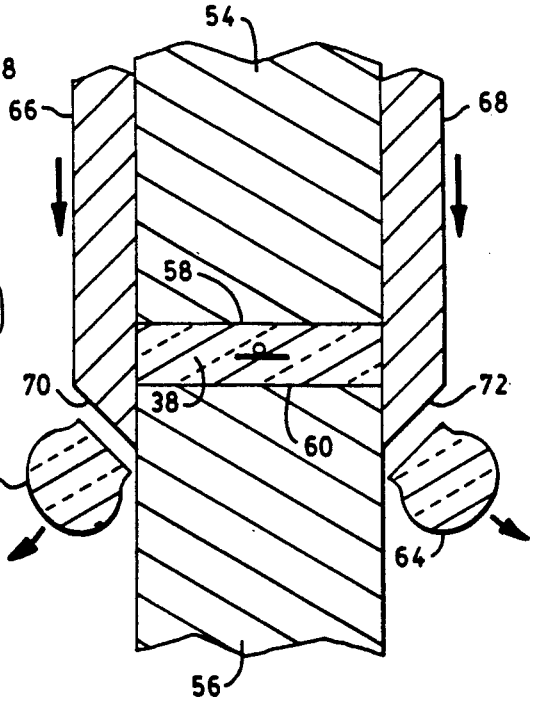
FIG. 8 shows a horizontal cross section of the press seal, press heads and knives partially broken after cutting away excess seal material.

After the preform 36 has been pressed to the electrode, the knives 66, 68 are advanced along the side faces of the first press head 54. Applicants prefer to slide the knives 58, 60 against the press head sides to assure an accurate alignment with respect to the captured first seal end 38. The knives 58, 60 with cutting faces 70, 72 cut off the overhanging masses 62, 64. The cutting faces 70, 72 encounter the overhanging masses 54, 56 and push the masses 62, 64 still in a pliable state. As the knives 58, 60 extend, the overhanging masses 54, 56 are scissored against the side edges of the opposite, press head 56. The overhanging material 62, 64 is thereby cut from the press seal end 38, leaving a reduced mass press seal 12. In one procedure, the excess preform material is cut away in sequential steps seperated in time by less than 30 seconds. The sheared off excess material falls away. The cross sectional mass of the first press seal 38 is then reduced by the amount of the overhanging material 62, 64 cut away. FIG. 8 shows knives 66, 68 after sliding along the exterior face of the press seal head 54 and contacting the overhanging masses 62, 64. The cross sectional mass of the envelope in the region of the enclosed volume remains as originally provided with a substantially regular wall surface, and the original cross sectional mass.

In the alternative, simultaneously with the press sealing the first seal end 38, a pressurizing gas may be applied through the second seal end 42. The pressurizing gas then balloons the capsule to enlarge the enclosed volume. The ballooning capsule portion may be unguided or controlled by a partial or complete mold fitted around the capsule. Pressure molding of lamps capsules is known in the art, and may be readily adapted to the method taught herein. Single or double ended bulbous lamps may be formed. The ballooning, or molding may stretch or thin the envelope wall 14, but these processes may be done without substantially altering the wall surface quality. Since, the lamp length is not substantially varied, the cross sectional area of the lamp in the capsule region is also not substantially changed.

With the mass of the first seal end 38 reduced, the press heads are then withdrawn and the press sealed preform 36 released for further processing. The capsule is then filled with a lamp fill. A second electrode is inserted in the second end, and the lamp is sealed. The lamp filling, and second end sealing steps may be completed by ordinary methods. Alternatively, the second sealed end may be similarly formed, so both ends of the lamp capsule have reduced mass seals. The capsule may be filled through a tubulation, but applicants prefer to fill the capsule through the second seal end 42 before the second seal is completed. The applicants further prefer to form both ends of the lamp capsule with reduced mass seals.

In a preferred embodiment some of the dimensions would be reduced from 6.096×2.54 millimeter (0.240×0.100 inch) to 4.064×1.778 millimeter (0.160×0.070 inch). The width of the press seal is then trimmed away, but since the excess material is also the thickest portion of the press seal, the thickness is also reduced. The suggested trimming is about a 50 percent reduction in the press seal mass and cross-sectional area, and a 30 percent reduction in the surface area of the press seal. A resulting cavity should then have a wall thickness of about 1.397 mm (0.055 inch) using 2 millimeter wall by 5 millimeter diameter quartz tubing. If it is determined that thicker walls are necessary to obtain acceptable peak wall temperatures and life, then tubing with thicker walls, such as 2 millimeter wall by 6 millimeter diameter tubing or 3 millimeter wall by 6 millimeter diameter tubing may be used. The seals resulting from the use of heavier wall tubing would be massive relative to the cavity. The performance gain by a seal reduction would be substantially greater in these cases.

Shearing excess quartz is expected to cut heat loss through the press seal by more than 50 percent, resulting in an increase in cold spot temperature. A substantial improvement in the performance of the lamp is expected. A similar area reduction in the open seal makes the press sealing or vacuum sealing of the open seal easier.

Quartz removal provides several performance benefits over arc tubes with standard press or vacuum seals. The quartz removal seal method provides a more consistent cavity dimension over the gathering material method. Wall thickness regularity is particularly relevant in small diameter tubes where accurate wall thickness and seal sizes is particularly difficult to achieve.

The initial tubing size and final press or seal area shape depends on individual lamp capsule requirements. Many variations are possible using individual press devices or integral press-molds. It may be desirable to neck in the press to cavity region. It may be desirable to simultaneously blow mold a portion of the capsule. By allowing the excess glass to flow from the necked area rather than forcing the neck material in towards the seal, or enclosure wall with side plates, the cavity end distortion is reduced. The excess envelope material may then be removed.

While there have been shown and described what are at present considered to be the preferred embodiments of the invention, it will be apparent to those skilled in the art that various changes and modifications may be made herein without departing from the scope of the invention defined by the appended claims.

What is claimed is:

1. A method of forming a reduced mass arc discharge lamp capsule comprising the steps of:

a) positioning a tubular lamp capsule preform around an electrode, b) heating the lamp capsule preform adjacent the seal area of the electrode to a pliable state, c) pressing the moldable preform against the electrode to seal the preform and electrode together, d) allowing the excess preform material adjacent the seal area to extend beyond the press faces, e) sliding a body along a side face of a press head to contact the excess preform material, and f) cutting the excess preform material from the lamp capsule preform while the excess material to produce a reduced mass arc discharge lamp capsule.

2. The method in claim 1, wherein cutting the excess preform material is accomplished while the excess preform is pliable.

3. The method in claim 2, wherein cutting the excess preform material is accomplished in sequential steps seperated in time by less than 30 seconds.

4. The method in claim 1 wherein the body includes a cutting edge brought in contact with the extended material.

5. The method in claim 1 wherein the body slides along a side face of a first press head and scissors the excess mass with a cutting edge working against a side face of a second press head.

* * * * *